US005107302A

United States Patent [19]

Bisaiji

[11] Patent Number: 5,107,302

[45] Date of Patent: Apr. 21, 1992

[54] IMAGE DENSITY CONTROL DEVICE FOR AN IMAGE FORMING APPARATUS

[75] Inventor: Takashi Bisaiji, Yokohama, Japan

[73] Assignee: Ricoh Company, Ltd., Tokyo, Japan

[21] Appl. No.: 652,375

[22] Filed: Feb. 7, 1991

Related U.S. Application Data

[63] Continuation of Ser. No. 426,157, Oct. 25, 1989, abandoned.

[30] Foreign Application Priority Data

Oct. 28, 1988 [JP] Japan ..... 63-140016
Aug. 25, 1989 [JP] Japan ..... 1-217266

[51] Int. Cl.[5] ..... G03G 21/00

[52] U.S. Cl. ..... 355/246; 355/203; 355/214

[58] Field of Search ..... 355/246, 203, 204, 214; 356/445, 448, 73; 250/571

[56] References Cited

U.S. PATENT DOCUMENTS 4,218,144 8/1980 Whitehouse et al. ..... 356/445
4,750,140 6/1988 Asano et al. ..... 356/445
4,796,065 1/1989 Kanbayashi ..... 355/246 X
4,803,374 2/1989 Monfort et al. ..... 250/571

FOREIGN PATENT DOCUMENTS 0023972 2/1982 Japan ..... 355/246
0209470 9/1986 Japan ..... 355/246
0304275 12/1988 Japan ..... 355/246
0304281 12/1988 Japan ..... 355/246
0035466 2/1989 Japan ..... 355/246

*Primary Examiner*—A. T. Grimley
*Assistant Examiner*—Nestor R. Ramirez
*Attorney, Agent, or Firm*—Oblon, Spivak, McClelland, Maier & Neustad

[57] ABSTRACT

An image density control device for an image forming apparatus produces a sufficient output with no regard to the amount of toner deposition on an electrostatic latent image and, based on the output, performs adequate image density control. The amount of toner deposition is sensed by a plurality of reflection type optical sensors each having a light emitting and a light-sensitive element. The angle between the optical axes of the light emitting and light-sensitive elements differs from one sensor to another. The sensor having a large angle and the sensor having a small angle as defined between the optical axes are used to sense a areference density pattern having a relatively low density and a reference density pattern having a relatively high density, respectively. The plurality of optical sensors may be replaced with a single optical sensor which is actuated by a drive mechanism to change the angle between the optical axes in matching relation to the density of the reference density pattern.

6 Claims, 9 Drawing Sheets

IMAGE DENSITY CONTROL DEVICE FOR AN IMAGE FORMING APPARATUS

This application is a continuation of application Ser. No. 07/426,157, filed on Oct. 25, 1989, now abandoned.

BACKGROUND OF THE INVENTION

The present invention relates to an image forming apparatus having an image carrier in the form of a photoconductive element and forming an image on the element by an electrophotographic procedure. More particularly, the present invention relates to an image density control device installed in such an apparatus for controlling the density of the image to be formed on the photoconductive element.

Generally, an electrophotographic copier, facsimile apparatus, laser printer or similar image forming apparatus has an operation board which includes an exclusive portion accessible for adjusting an image density to the user's taste. In practice, however, the image density selected on the operation board sequentially changes due to the aging of a photoconductive element and a lamp, the shortage of toner, the fluctuation of bias voltage for development, etc. In the light of this, it has been customary to form an electrostatic latent image of a reference density pattern having a reference density on a photoconductive element outside of a document loading area, develop the latent image by a toner, sense the resulting amount of toner deposition on the latent image, and then correct the image density on the basis of the sensed amount of toner deposition. With this kind of image density control, it is possible to provide any desired image density by forming the toner density representative of the reference density pattern by an ordinary image forming procedure and by suitably selecting the reference density of the reference pattern. Specifically, the density is corrected by adjusting the output of a charger, lamp regulator or bias voltage for development or, alternatively, by on-off controlling a toner supply unit. More specifically, a toner image of a reference density pattern is formed on a photoconductive element while the amount of toner deposition thereon is sensed by a single optical sensor, so that various process units of the image forming apparatus are controlled in response to the sensed amount. An image density control device adopting this kind of principle is extensively used because the construction is simple and because the use of a single sensor saves cost. This type of prior art image density control device is disclosed in Japanese Patent Laid-Open Publication No. 57-76564, for example.

The optical sensor for the above application is usually made up of a light emitting element for illuminating the toner image formed on the photoconductive element, and a light-sensitive element to which a reflection from the drum is incident. The light emitting and light-sensitive elements are positioned such that their optical axes intersect each other at a certain angle on the surface of the photoconductive element, allowing light issuing from the light emitting element to be reflected by the toner image on the photoconductive element to reach the light-sensitive element. In this manner, the amount of toner deposition has heretofore been sensed by a single optical sensor which is constituted by a light emitting and a light-sensitive element.

The single optical sensor is usually fixed in place with its light emitting and light-sensitive elements individually held in predetermined positions, i.e., the optical axes of the two coactive elements are not changeable in direction and angle to each other. Such an optical sensor often fails to produce a sufficient output in association with the amount of toner deposition, i.e., the density of the toner image of a reference density pattern. For example, when the optical axes of the sensor are fixed at a given angle to each other, it may occur that the sensor successfully produces an output faithfully representative of the amount of toner of a toner image of a reference density pattern having a relatively high density, but it fails to do so when it comes to a toner image of a reference density pattern having a relatively low density. Experiments showed that a relatively large angle between the optical axes allows a sufficient output to be produced with a reference pattern having a relatively high density, while a relatively small angle allows a sufficient output to be produced with a reference pattern having a relatively low density. However, sufficient outputs were not achieved in the contrary situations. More specifically, the prior art optical sensors each having a light emitting and a light-sensitive element whose optical axes are fixed in the angle to each other were not capable of sensing all the amounts of toner densities associated with a plurality of reference density patterns each having a different reference density with accuracy. Thus, an optical sensor capable of sensing a broad range of toner densities, i.e., amounts of toner deposition with accuracy has been keenly demanded.

SUMMARY OF THE INVENTION

It is therefore an object of the present invention to provide an image density control device for an image forming apparatus which uses an optical sensor capable of producing a sufficient output with no regard to the amount of toner deposition on a photoconductive element and, based on the output of the sensor, executes adequate image density control.

It is another object of the present invention to provide a generally improved image density control device for an image forming apparatus.

In accordance with the present invention, in an image density control device for an image forming apparatus which develops an electrostatic latent image representative of an original document and formed on a photoconductive element by using a toner, senses an amount of toner deposited on the latent image, and controls image density on the basis of the sensed amount of toner deposition, a toner pattern image forming arrangement develops a plurality of reference density patterns each having a different density by using the toner and thereby forms toner pattern images on the photoconductive element. An optical sensor arrangement comprises a light emitting element for issuing light toward the toner pattern images and a light-sensitive element to which a reflection from the toner pattern images are incident. The optical sensor arrangement selects an angle between optical axes of the light-emitting element and the light-sensitive element in association with the densities of the toner pattern images.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, prior art image density control will be described together with the more specific background of the invention.

Figure 1:
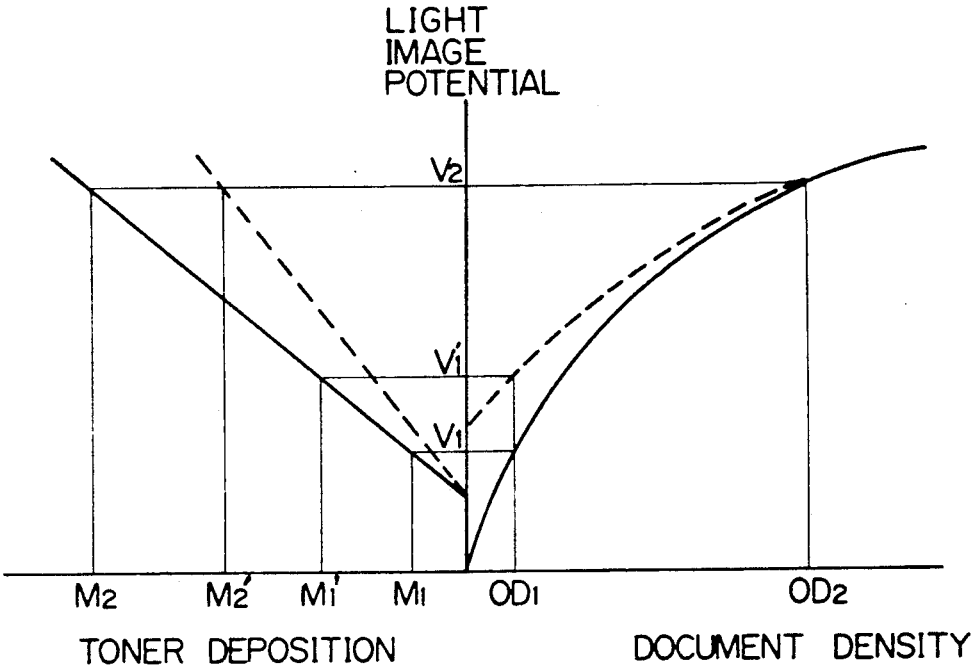
FIG. 1 is a graph showing a relationship between the density of a document image, potential of a latent image, and amount of toner deposition.

Referring to FIG. 1 of the drawings, there is shown a relationship between the density of an original document image, the potential of an electrostatic latent image formed on a photoconductive element, and the amount of toner deposited on the latent image by development. Specifically, in FIG. 1, the first quadrant indicates a relationship between the density of an original document image (abscissa) and the potential of a latent image (ordinate), while the second quadrant indicates a relationship between the amount of toner deposition (abscissa) and the potential of a latent image. In each of the first and second quadrants, the solid curve and the dotten curve represent respectively an optimal variation and a variation ascribable to the aging of a photoconductive element and other processing units. More specifically, some photoconductive elements have photoconductivity which is susceptible to aging, and the dotted curve in the first quadrant indicates the deteriorated photoconductivity. As shown, the deterioration ascribable to aging sharply increases the latent image potential from $V_1$ to $V'_1$ in a relatively low document image density range $OD_1$, whereby the amount of toner deposition in a developing unit is increased from $M_1$ to $M'_1$. Such an increase in the amount of toner deposition would eventually smear the background of a reproduction. On the other hand, it is known with a developing unit which is implemented by a two-component developer that the deposition of a toner on a latent image is noticeably effected by the density of the toner. Specifically, even though the latent image density $V_2$ may remain constant in a relatively high document image density range $OD_2$, a decrease in the toner density in a developing unit causes the amount of toner deposition to decrease from $M_2$ to $M'_2$ resulting in the image density being lowered.

In the light of the above, an arrangement may be so made as to form on a photoconductive element electrostatic latent images of reference density patterns each being representative of respective one of a relatively low and a relatively high density characteristic. Then, the amounts of toner deposited on the individual latent images by development will be detected to determine how the individual characteristics have changed and to thereby control the toner density such that the individual toner images have adequate densities. However, a problem is that the amounts of toner deposition $M_1$ and $M_2$ differ from the low density characteristic to the high density characteristic.

Figure 2:
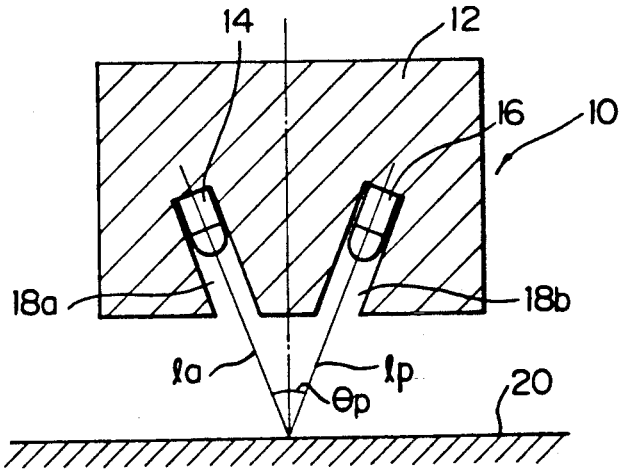
FIG. 2 is a section showing a specific construction of an optical sensor.
Figure 3:
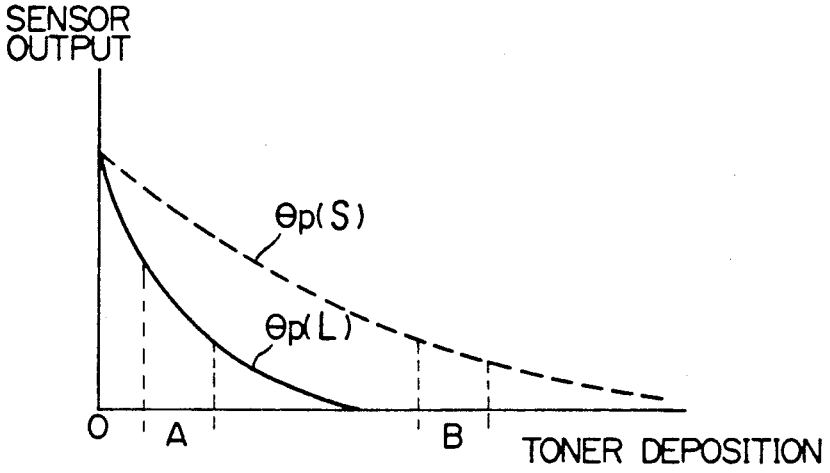
FIG. 3 is a graph showing a relationship between the amount of toner deposition and the output of an optical sensor.

Experiments were conducted to determine a relationship between the amount of toner deposition and the output of an optical sensor used to sense it, with respect to different angles between the optical axes of a light emitting and a light-sensitive element which constitute the sensor. As shown in FIG. 2 schematically, the optical sensor, generally 10, has a light emitting element 14 and a light-sensitive element 16 which are received in a holder 12. This kind of sensor 10 is often referred to as a photoreflector. The elements 14 and 16 have respectively optical axes $l_a$ and $l_p$ which make an angle $\theta_p$ therebetween. The optical paths associated with the elements 14 and 16 are labeled 18*a* and 18*b*, respectively. The optical axes $l_a$ and $l_p$ intersect each other on a photoconductive element 20 so that light issuing from the element 14 may be incident to the element 16 after being reflected by the photoconductive element 20. By using the optical sensor 10, the relationship mentioned above was measured as shown in FIG. 3 in which the abscissa and ordinate indicate respectively the amount of toner deposition and the output of the optical sensor 10. In FIG. 3, the solid curve $\theta_p(L)$ and the dashed curve $\theta_p(S)$ are representative of a characteristic derived from a relatively large angle $\theta_p$ and a characteristic derived from a relatively small angle $\theta_p$, respectively. The experiments showed that the angle $\theta_p$ should be relatively large for a region A, for example, where the amount of toner deposition is small and relatively small for a region B where it is large; in the region B, an optical sensor 10 having a relatively large angle $\theta_p$ did not change in output and therefore failed to function.

Figure 4:
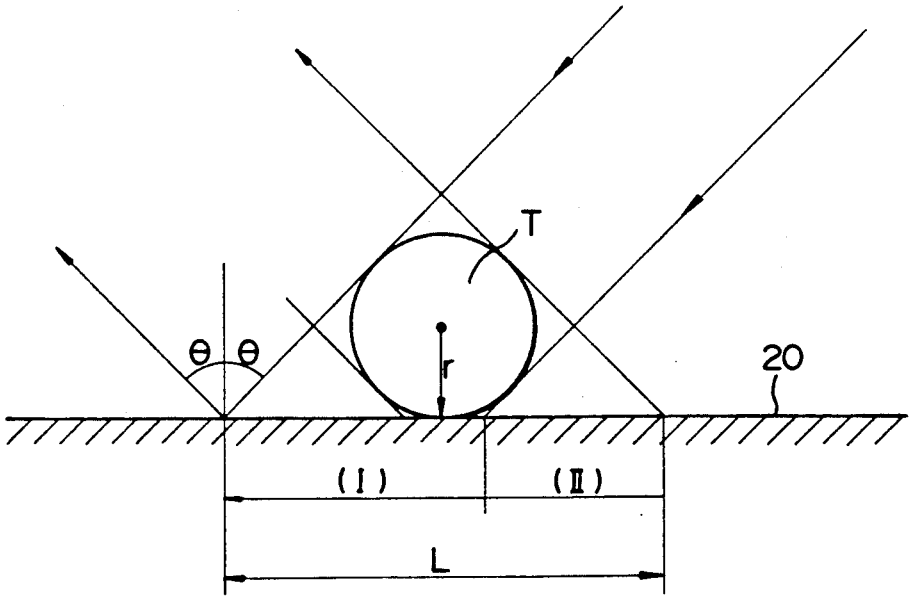
FIG. 4 is a sketch showing a toner particle deposited on a photoconductive element and forming a "shadow" on the latter.

The relationship between the angle $\theta_p$ between the optical axes $l_a$ and $l_p$ of the sensor 10 and the output of the sensor 10 will be described more specifically. Basically, the sensor 10 is constructed such that light issuing from the light emitting element 14 is reflected by the photoconductive element 20 to become incident to the light-receiving element 16, the amount of toner deposition being estimated in terms of the amount or intensity of the incident light. The light emitting element 14 and light-sensitive element 16 may be implemented by an LED (Light Emitting Diode) and a phototransistor or photodiode, respectively. Although the amount of toner deposition on the photoconductive element 20 may be the same, the amount of reflection from the element 20 depends on the angle $\theta_p$ between the optical axes $l_a$ and $l_p$. Presumably, this results from the influence of a "shadow" which is ascribable to a difference in the optical axes $l_a$ and $l_p$ of the light emitting and light-sensitive elements 14 and 16, i.e., a difference in area between "shadows". Specifically, as shown in FIG. 4, assume that a toner particle T having a radius $r$ is deposited on the surface of the photoconductive element 20, that light (parallel beam) is incident to the element 20 at an angle $\theta$, and that a reflection from the element 20 reflected by the same angle $\theta$ is sensed. Then, there are produced below the toner particle T a region (I) which is not illuminated by the light emitting element 14 at all and therefore does not reflect light toward the light-sensitive element 16, and a region (II) which is illuminated by the light emitting element but fails to reflect the light to the light-sensitive element 16 by being intercepted by the toner particle T. When the optical paths of the light emitting and light-sensitive elements 14 and 16 are viewed from the side, the "shadow" area which the light-sensitive element 16 cannot sense has a length L:

$$L=2r(\tan\theta+\sec\theta)$$

It follows that the greater the angle of incidence $\theta$, i.e., the angle $\theta_p$ between the optical axes $l_a$ and $l_p$, the greater the "shadow" area or length L becomes. It is therefore presumable that for a given amount of toner deposition the amount of reflection from the photoconductive element 20 decreases with the increase in the angle $\theta_p$ due to the area of "shadow", resulting in the regions which are unable to reflect light.

When the toner density control and background control are implemented by the optical sensor 10, some different methods are available for forming a toner image on the photoconductive element 20 which is representative of a reference density pattern. Specifically, by tone density control, the amount of toner deposition at a given surface potential is maintained in a predetermined range. Hence, a latent image of a reference density pattern needs only to be formed on the photoconductive element 20 by any method of the kind depositing a predetermined potential on the element 20. Such a method generally relies on optics for imagewise exposure or the combination of a charger and an eraser. The optics scheme may be such that a reference density pattern having a reference density is provided on a document carrier outside of a document loading area so as to form its latent image by an ordinary electrostatic procedure, or such that a shutter disposed on an optical path for imagewise exposure interrupts the optical path to form the latent image of the reference density pattern. On the other hand, the charger and eraser scheme may be such that after a charger has uniformly charged a photoconductive element, an eraser erases it except for an area where the latent image of the reference pattern is to be formed, thereby forming the latent image of the reference density pattern.

Figure 5:
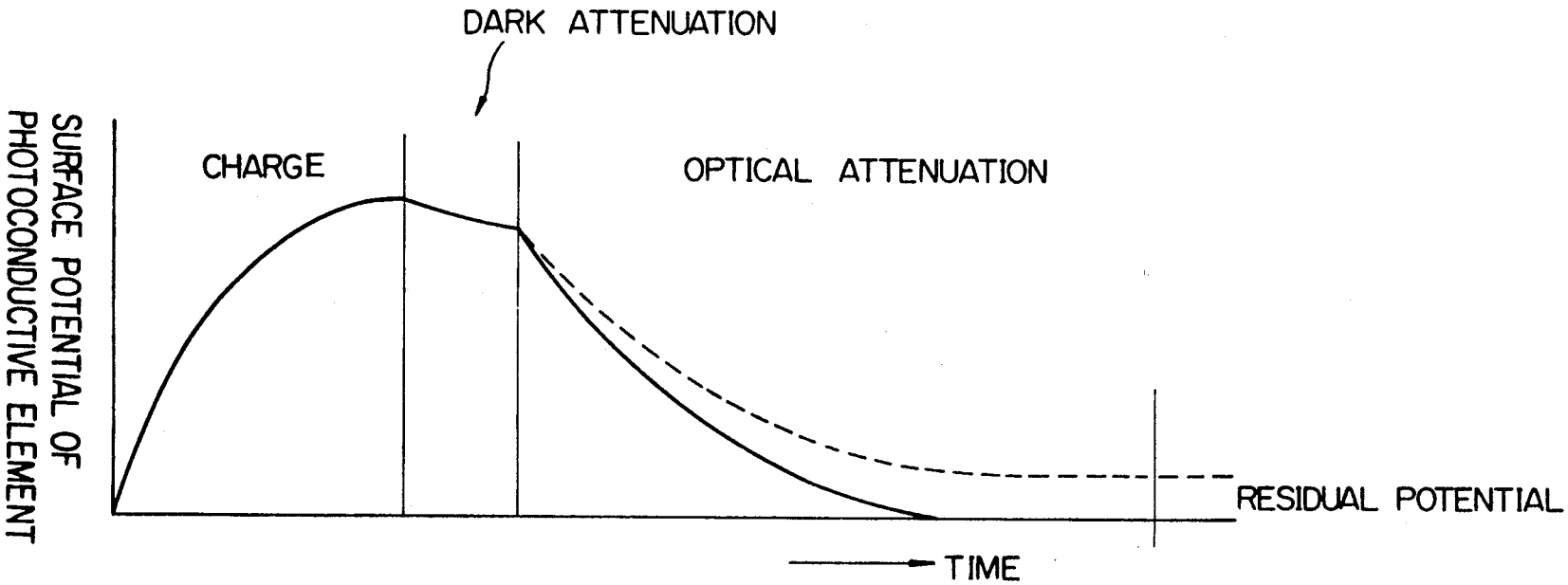
FIG. 5 is a graph showing a residual potential on a photoconductive element with respect to time.

Meanwhile, the background control is performed by detecting the deterioration in the electrostatic characteristics, especially light attenuation characteristic, of a photoconductive element due to aging. It is necessary, therefore, to form the latent image of a reference density pattern adapted for background control by an exposing step. It is a common practice to form a pattern representative of a particular density, i.e., a background potential on a document carrier outside of a document loading area, and to form a latent image thereof by an ordinary step. Generally, the deterioration of light attenuation characteristic is considered as being derived from residual potential. As shown in FIG. 5, residual potential refers to a potential which remains without being fully attenuated within a light attenuating time due to the fatigue of a photoconductive element.

Figure 6:
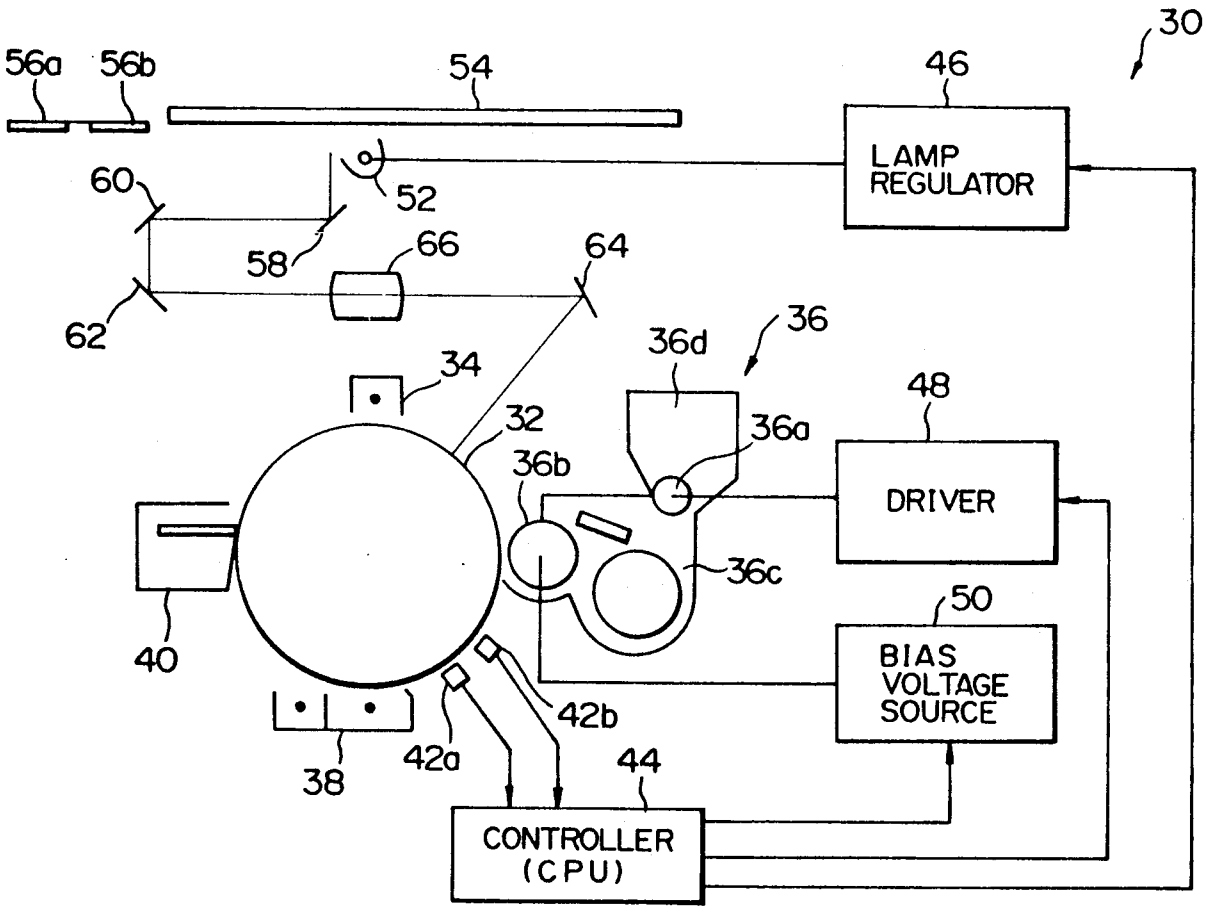
FIG. 6 is a side elevation of an image forming apparatus to which an image density control device of the present invention is applied.

Referring to FIG. 6, an image forming apparatus to which an image density control device embodying the present invention is applied is shown schematically and designated by the reference numeral 30. As shown, the apparatus 30 has a photoconductive element in the form of a drum 32. A main charger 34, a developing unit 36, a transfer and separation unit 38 and a cleaning unit 40 are arranged around the drum 32 in the order of image forming sequence. Two optical sensors **42*a* and 42*b* are located between the developing unit 36 and the transfer and separation unit 38 while facing the surface of the drum 32. The sensors 42*a* and 42*b* are respectively responsive to the amounts of toner deposition on reference density patterns 56*b* and 56*a* which will be described. The sensors 42*a* and 42*b* are connected to a controller 44 which is implemented as a CPU (Central Processing Unit). In response to the outputs of the sensors 42*a* and 42*b*, the controller 44 delivers control commands to a lamp voltage regulator 46, a driver 48 for driving a toner supply roller 36, and a bias voltage source 50 for applying a bias voltage to a developing roller 36*b*. A lamp 52 is controlled by the lamp voltage regulator 46 to illuminate a document loaded on a glass platen 54 or the two reference density patterns 56*a* and 56*b* located outside of a document loading range of the glass platen 54. A reflection from the document or the reference density patterns 56*a* and 56*b* is focused by mirrors 58, 60, 62 and 64 and a lens 66 onto the drum 32. As a result, latent images associated with the reference patterns 56*a* and 56*b*, for example, are electrostatically formed on the drum 32. The driver 48 drives the toner supply roller 36*a* to supply a toner from a hopper 36*d* into a developing tank 36*c*, as needed. The bias voltage source 50 applies an adequate bias voltage to a developing roller 36*a* of the developing unit 36**.

The reference density patterns **56*a* and 56*b* have respectively reference densities which correspond to original document densities $OD_1$ and $OD_2$ shown in FIG. 1. In the illustrative embodiment, latent images of the reference density patterns 56*a* and 56*b*** are formed by, among the previously discussed methods, the method which uses optics by way of example. In this respect, therefore, a device for forming latent images of the reference density patterns as mentioned in this embodiment refer to the entire image forming arrangement including optics and developing unit.

In operation, the latent images of the reference density patterns **56*a* and 56*b* formed on the drum 32 by an ordinary latent image forming process are developed by the developer 36. The resulting toner images individually representative of the patterns 56*a* and 56*b* are sensed by the sensors 42*a* and 42*b* each being constituted by a light emitting element and a light-sensitive element. The sensor 42*a* is located downstream of the sensor 42*b* with respect to the intended direction of rotation of the drum 32. In the illustrative embodiment, the downstream sensor 42*a* has a light emitting element 14 and a light-sensitive element 16 the optical axes $l_a$ and $l_p$ of which define a larger angle $\theta_p$ than the optical axes $l_a$ and $l_p$ of the light emitting and light-sensitive elements 14 and 16 of the upstream sensor 42*b*. The toner images representative of the reference density patterns 56*b* and 56*a* are sensed by the sensors 42*a* and 42*b***, respectively.

Figure 7:
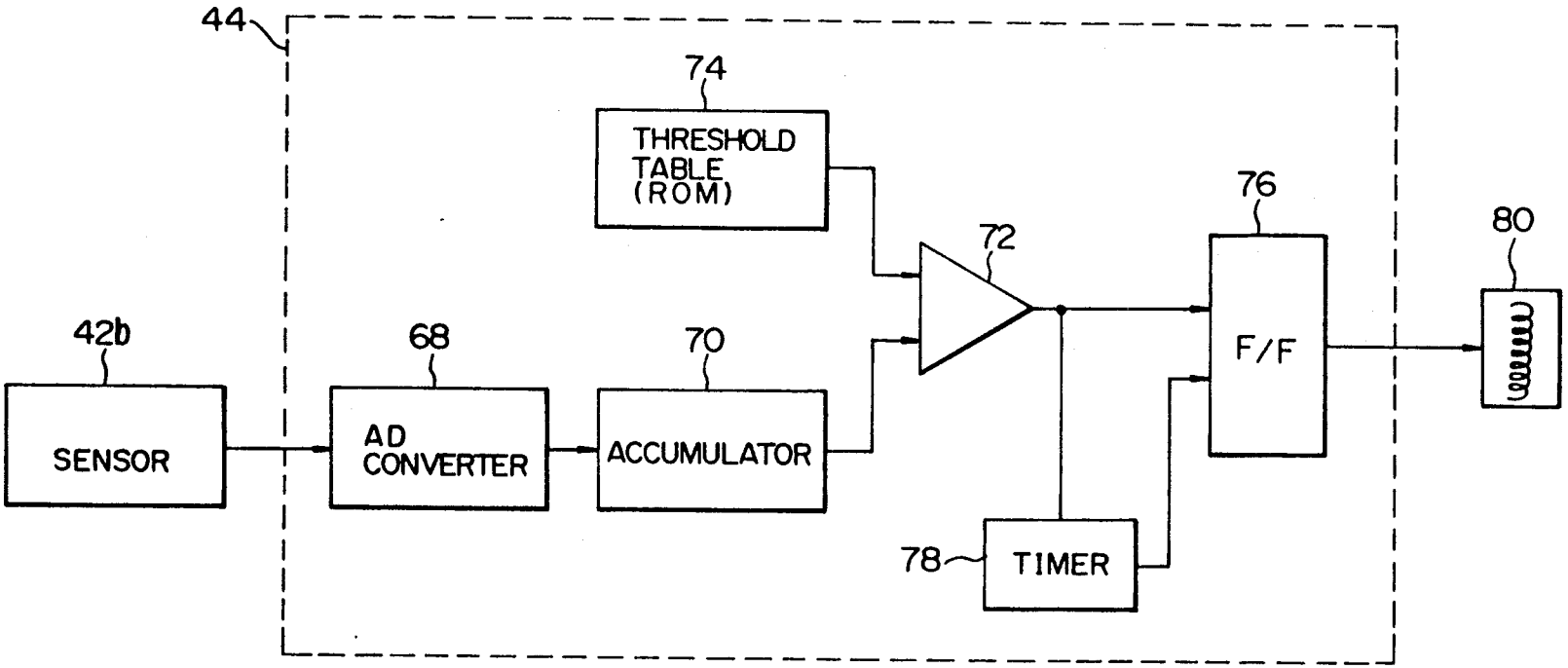
FIG. 7 is a schematic block diagram showing a circuit which is used in a toner supply mode.

As shown in FIG. 7, the controller 44 has an analog-to-digital (AD) converter 68 to which the output of the sensor **42*b* is applied. The AD converter 68 converts the input analog amount into a digital amount and delivers it to an accumulator 70. A value accumulated by the accumulator 70** (hereinafter referred to as ACC value)

is applied to a comparator 72. The comparator 72 compares the ACC value with a value listed in a threshold table 74 which is implemented by a ROM table, thereby determining whether or not to supply the toner. The resulting output of the comparator 72 is routed to a set terminal of a flip-flop 76 and a timer 78, whereby the flip-flop 76 is set and the timer 78 is caused to run. The output of the timer 78 is coupled to a reset terminal of the flip-flop 76 so that on the lapse of a predetermined period of time after the setting of the flip-flop 76, the flip-flop 76 is reset by the timer 78. A toner supply clutch 80 for driving the toner supply roller 36*a* is coupled when the flip-flop 76 is set and uncoupled when the latter is reset. The control which is based on the output of the sensor 42*b* as described above is the so-called toner supply control for controlling the toner supply roller 36*a*. A specific procedure for the toner supply control will be described with reference to FIG. 8.

Figure 8:
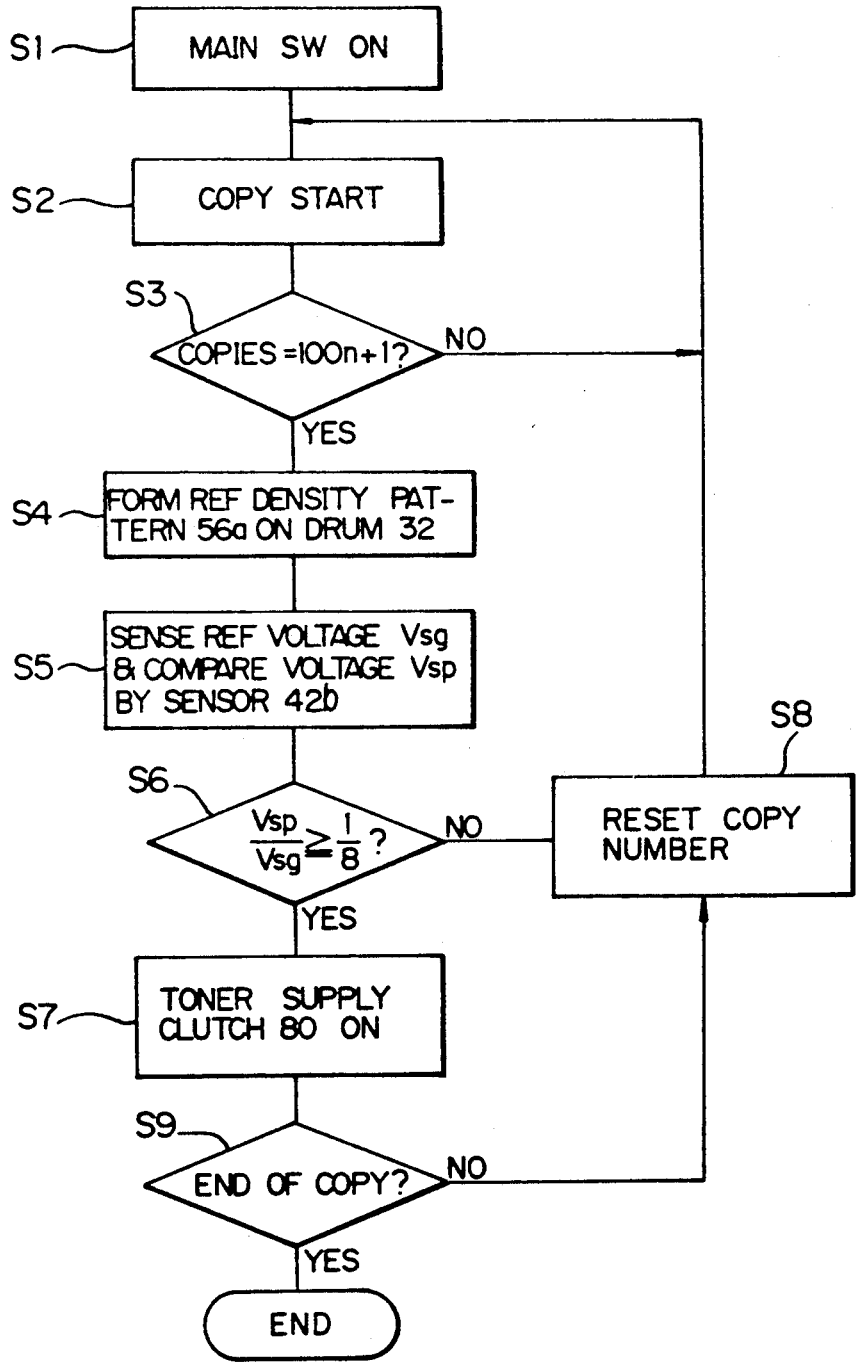
FIG. 8 is a flowchart demonstrating a specific procedure for implementing the toner supply mode.

As shown in FIG. 8, a main switch of the image forming apparatus is turned on (step $S_1$), and then a copying operation begins (step $S_2$). The toner supply control mode begins with a step $S_3$ for determining whether or not a predetermined number of copies have been produced; in the illustrative embodiment, the predetermined number of copies is selected to be 100 copies. The latent image of reference density pattern 56*a* is formed on the drum 32 every time 100 copies are produced (step S4). Subsequently, the light-sensitive element 16 of the sensor 42*b* senses the potential of the non-pattern forming area (background) and the potential of the latent image of the reference density pattern 56*a*, i.e., a comparison potential VSP and a reference potential Vsg (step $S_5$). The resulting ratio Vsp/Vsg is compared with a value stored in the threshold table 74, e.g., $\frac{1}{8}$ by the comparator 72 (step $S_6$). If the answer of the step $S_6$ is YES, the flip-flop 76 is set to couple the toner supply clutch 80 (step $S_7$) for thereby supplying the toner. After the toner supply, whether or not the preset number of copies have been fully produced is determined (step $S_8$). If the answer of the step $S_8$ is YES, the toner supply control mode is ended; if otherwise, the program returns to the step $S_2$ after resetting the number of copies (step $S_9$). If the answer of the step $S_6$ is NO, meaning that the toner supply is not necessary at that moment, the program also returns to the step $S_2$ after resetting the number of copies in the step $S_9$.

Figure 9A:
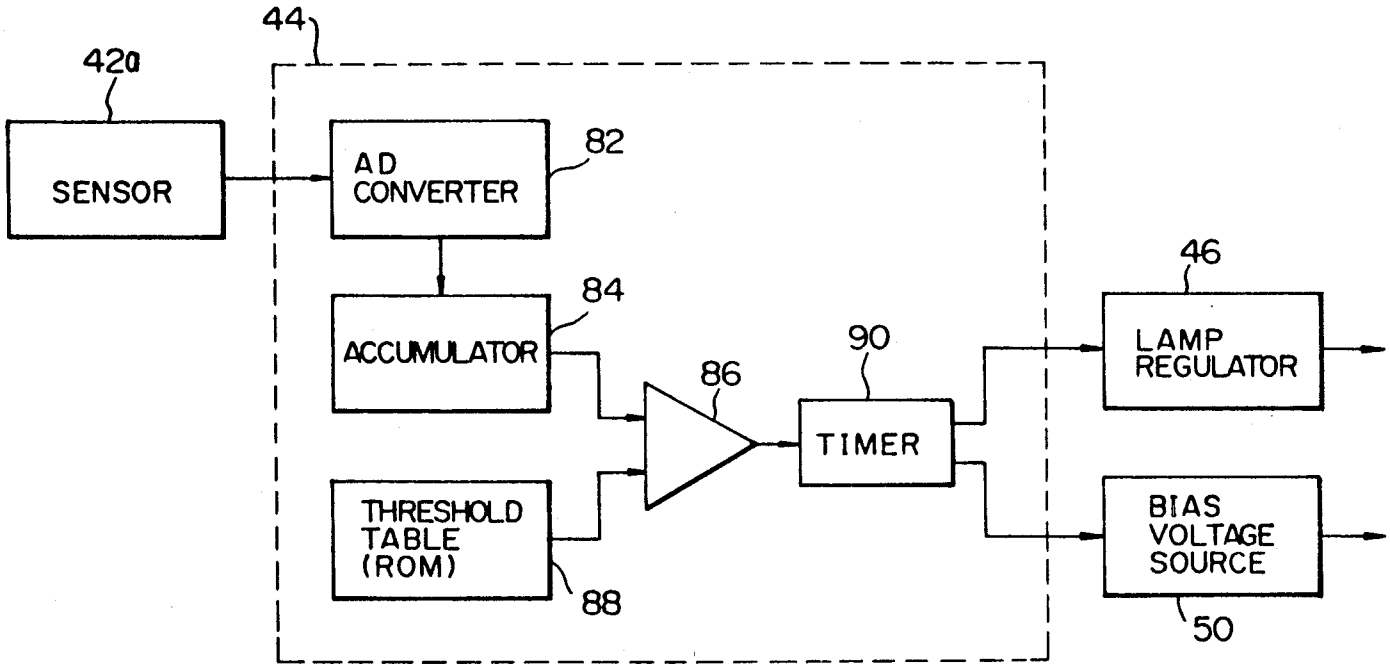
FIG. 9A is a schematic block diagram showing a circuit which is used in a background control mode.
Figure 9B:
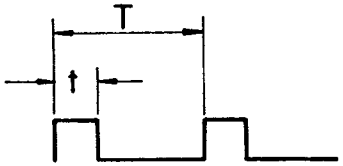
FIG. 9B shows a pulse width modulation waveform used in the background control mode and representative of a control output.

As shown in FIG. 9A, the output of the other sensor 42*a* is applied to an AD converter 82 which is also incorporated in the controller 44. The digital output of the AD converter 82 is fed to an accumulator 84. The ACC value outputted by the accumulator 84 is delivered to a comparator 86 to be compared with a value listed in a threshold table 88 which is constituted by a ROM table. The threshold table 88 is adapted to select an output of the lamp regulator 46 and an output of the bias voltage source 50. The output of the comparator 86 is fed to a timer 90 which automatically runs at every predetermined period T. Based on the result of comparison from the comparator 86, the timer 90 sets data associated with the lamp regulator 46 and bias voltage source 50 and thereby produces a pulse width modulation (PWM) waveform as shown in FIG. 9B. In FIG. 9B, the waveform is shown as having a period of T and an active time of t. The control using the output of the sensor 42*a* described above is the so-called background control for controlling the output of the lamp regulator 46 and that of the bias voltage source 50. Such a background control mode will be described more specifically with reference to FIG. 10.

Figure 10:
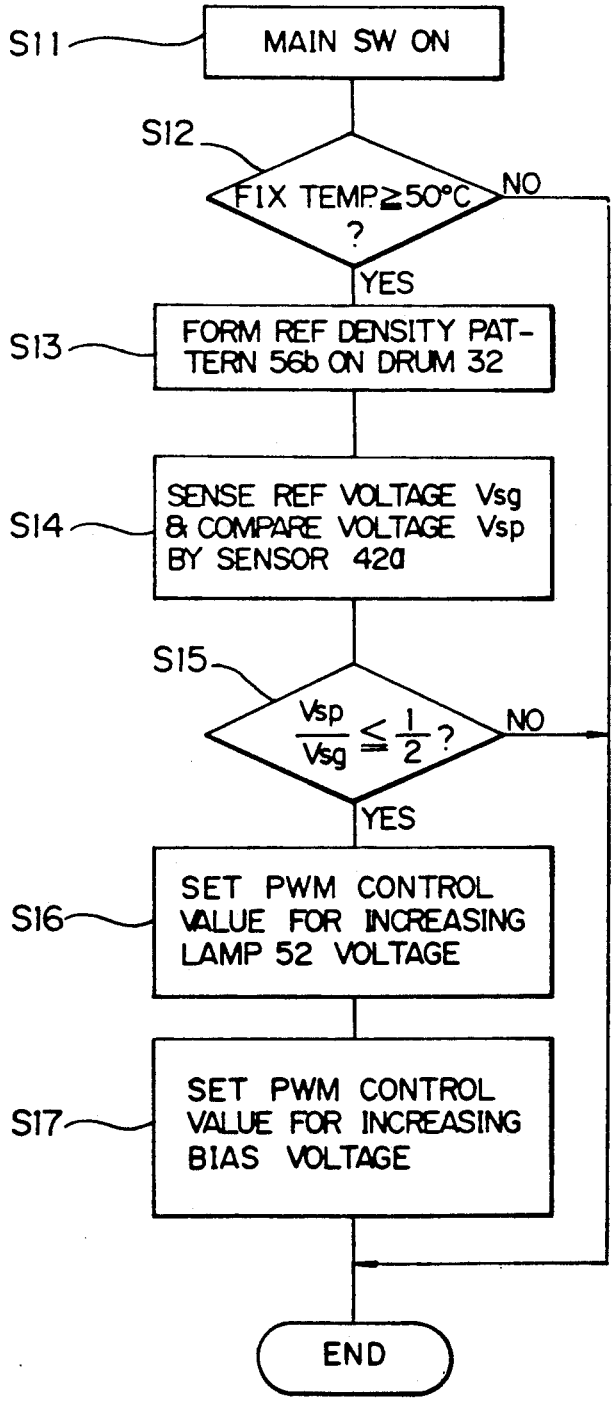
FIG. 10 is a flowchart demonstrating a specific procedure for implementing the background control mode.

In FIG. 10, after the main switch has been turned on (step $S_{11}$), whether or not the fixing temperature is higher than a predetermined level, e.g., 50° C. as in the illustrative embodiment is determined (step $S_{12}$). If the answer of the step $S_{12}$ is YES, a latent image of the reference density pattern 56*b* is formed on the drum 32 (step $S_{13}$). Subsequently, the light-sensitive element 16 of the sensor 42*a* senses the potential of the non-pattern area (background) of the drum 32 and the potential of the latent image of the reference density pattern 56*b*, i.e., a comparison potential Vsp and a reference potential Vsg (step $S_{14}$). The resulting ratio Vsp/Vsg is compared by the comparator 86 with a value stored in the threshold table 88, i.e., $\frac{1}{2}$ (step $S_{15}$). If the answer of the step $S_{15}$ is YES, meaning that the background has been too contaminated to provide a sufficient contrast, the timer 90 sets up a PWM waveform having a duty ratio of period T and active time t that increases the voltage to be applied to the lamp 52 (FIG. 6) (step $S_{16}$) and, further, a PWM waveform the duty ratio of which increases the bias voltage for development (step $S_{17}$). This is the end of the background control mode. If the answer of the step $S_{12}$ is NO, the background control mode is cancelled because the predetermined background density control cannot be performed. If the answer of the step $S_{15}$ is NO, the background control mode is also cancelled because the contamination of the background is not so severe and does not need background density control.

As described above, the illustrative embodiment controls toner density by controlling the amount of toner supply on the basis of the output of the sensor 42*b* and the outputs of the lamp regulator 46 and bias voltage source 50 on the basis of the output of the sensor 42*a*. The reference density patterns 56*a* and 56*b* are accurately sensed by the two sensors 42*a* and 42*b* which are different from each other in the angle $\theta_p$ between optical axes $l_a$ and $l_p$.

In the embodiment shown and described, either one of the two sensors 42*a* and 42*b* which are different in angle $\theta_p$ from each other as stated above is selected as needed. This is successful in broadening the range of the amounts of toner deposition over which sufficient sensitivity is achievable and, therefore, in enhancing the density control ability. The optical sensors replace a surface potential sensor or similar expensive sensor heretofore used, thereby cutting down the cost.

Figure 11:
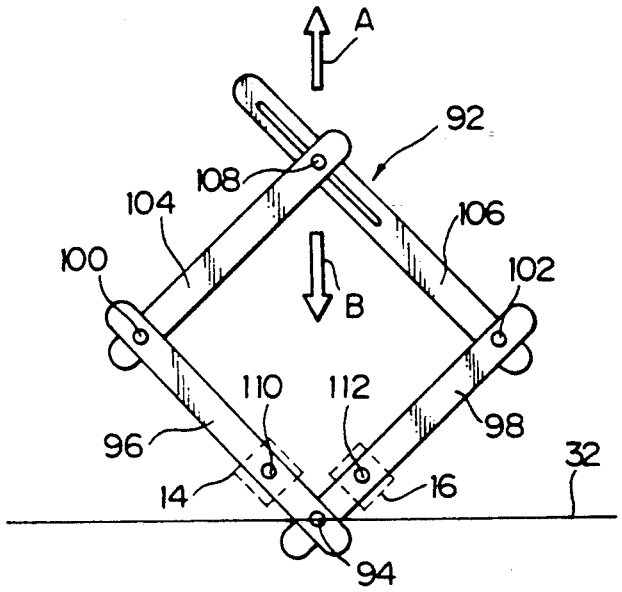
FIGS. 11 and 12 are respectively a front view and a side elevation showing an alternative embodiment of the present invention.
Figure 12:
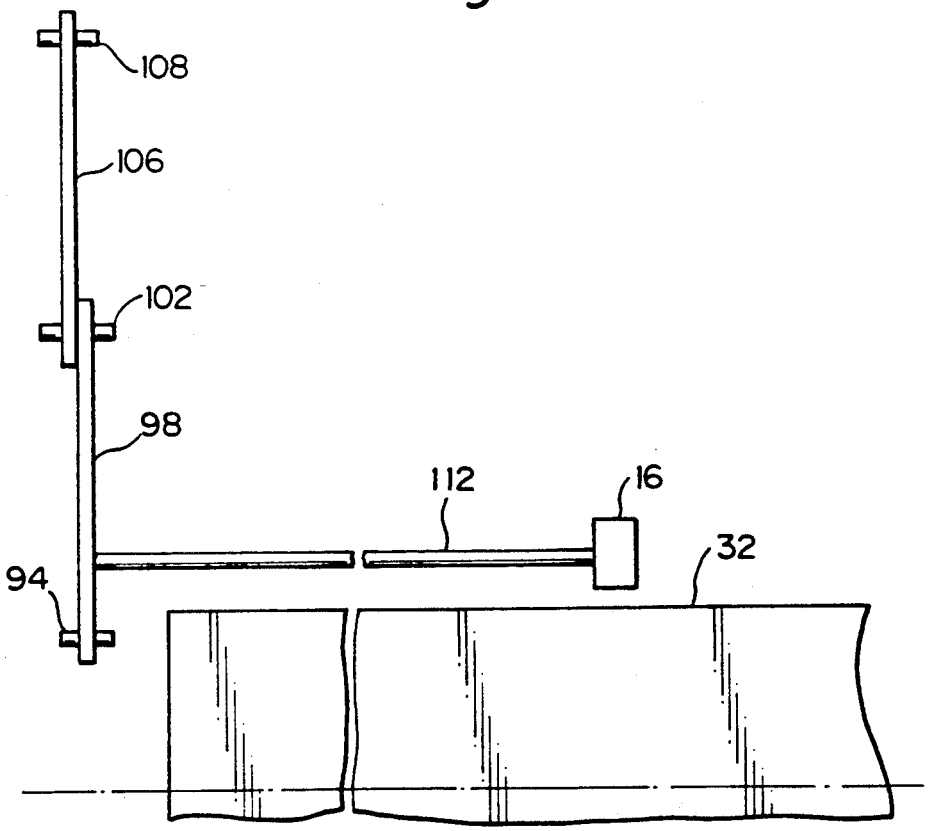

Referring to FIGS. 11 and 12, an alternative embodiment of the present invention is shown. In the previous embodiment, two sensors 42*a* and 42*b* each having a different angle $\theta_p$ are selectively used depending upon the control mode, i.e., toner supply control mode or background control mode in relation to the reference density patterns 56*a* and 56*b*. In contrast, the alternative embodiment shown in FIGS. 11 and 12 implements the two different modes by using a single optical sensor. In the alternative embodiment, the same components or structural elements as those of the first embodiment are designated by like reference numerals, and redundant description will be avoided for simplicity.

In FIGS. 11 and 12, a link mechanism 92 has a pair of first arms 96 and 98 which are rotatably supported by a stationary pin 94, a pair of second arms 104 and 106 connected to the other end of the first arms 96 and 98 by pins 100 and 102, respectively, and a pin 108 interconnecting the second arms 104 and 106 rotatably relative to each other. As shown in FIG. 12, third arms 110 and 112 individually extend sideways from the first arms 96 and 98 in parallel with the axis of rotation of the drum 32. More specifically, each of the arms 110 and 112 extends along the periphery of the drum 32 as far as substantially the intermediate between the opposite ends of the latter. The light emitting element 14 and the light-sensitive element 16 are individually affixed to the tips of the third arms 110 and 112 with their optical axes $l_a$ and $l_p$ extending parallel to the lengthwise direction of the first arms 96 and 98. In this configuration, light issuing from the light-emitting element 14 will be incident to the light-sensitive element 16 after being reflected by the drum 32. The second arm 106 is longer than the other second arm 104 and is connected at its free end to a drive mechanism, not shown, which drives the link mechanism 92.

In operation, the drive mechanism selectively drives the second arm 106 in opposite directions as indicated by arrows A and B. This causes the first arms 96 and 98 to rotate about the stationary pin 94. Consequently, the angle of each of the first arms 96 and 98 to the surface of the drum 32 and, therefore, the angle $\theta_p$ between the optical axes $l_a$ and $l_p$ of the light emitting and light-sensitive elements 14 and 15 is changed. Therefore, only if a plurality of such angles are selected beforehand, any of them will be set up in response to an angle change command from controller 44. In this embodiment, therefore, the link mechanism 92 plays the role of means for changing the angle between the optical axes $l_a$ and $l_p$. Specifically, for the toner supply control mode the link mechanism 92 will be driven in the direction A to reduce the angle $\theta_p$ between the optical axes $l_a$ and $l_p$ while, for the background control mode, it will be driven in the direction B to increase the angle $\theta_p$. With the configuration shown in FIGS. 11 and 12, it is also possible to adjust the angle $\theta_p$ adequately in matching relation to the characteristic curves shown in FIG. 3.

The alternative embodiment shown and described accommodates a plurality of different modes by using a single optical sensor. Since the angle $\theta_p$ between the optical axes $l_a$ and $l_p$ of the sensor is free to control within a certain range, the alternative embodiment promotes more delicate density control than that of the first embodiment.

In summary, in accordance with the present invention, an image density control device for an image forming apparatus changes the density of a reference density pattern in matching relation to the kind of image density control. This, coupled with the fact that one of a plurality of optical sensors each having a different angle between optical axes is selected in association with the density to be selected, insures a sensed output necessary for density control at all times and thereby promotes adequate image density control.

Various modifications will become possible for those skilled in the art after receiving the teachings of the present disclosure without departing from the scope thereof.

What is claimed is:

1. An image density control device for an image forming apparatus which develops an electrostatic latent image representative of an original document and formed on a photoconductive element by using a toner, senses an amount of toner deposited on said latent image, and controls image density on the basis of the sensed amount of toner deposition, said device comprising:

toner pattern image forming means for developing a plurality of reference density patterns each having a different density by using the toner and thereby forming toner pattern image on the photoconductive element; and optical sensor means comprising a light emitting element for issuing light toward said toner pattern images and a light-sensitive element to which a regular reflection from said toner pattern images are incident, said optical sensor means selected an angle between optical axes of said light-emitting element and said light-sensitive element in association with the densities of said toner pattern images, said optical sensor means comprising a plurality of optical sensors which are different from each other in the angle between the optical axes of the light emitting and light-sensitive elements, said plurality of optical sensors comprising a toner supply control sensor having a small angle between the optical axes for sensing said toner pattern image with a large amount of toner deposited thereon and a background control sensor having a large angle between the optical axes for sensing said toner pattern image with a small amount of toner deposited thereon, said toner supply control sensor functioning to control an amount of toner supplied from a toner hopper to a developing tank in a developing unit, and said background control sensor functioning to control both a light voltage applied to an exposure lamp of an exposure unit and a bias voltage applied to a developing roller of the developing unit.

2. An image density control device for an image forming apparatus which develops an electrostatic latent image representative of an original document and formed on a photoconductive element by using a toner of a developing unit, senses an amount of toner deposited on said latent image, and controls image density on the basis of the sensed amount of toner deposition, said device comprising:

toner pattern image forming means for developing a plurality of reference density patterns each having a different density by using the toner and thereby forming toner pattern images on the photoconductive element, said plurality of reference density patterns comprising a first pattern having a low density and a second pattern having a high density;

a plurality of optical sensors each comprising a light emitting element for issuing light toward said toner pattern images and a light-sensitive element to which a regular reflection from said toner pattern images are incident, and plurality of optical sensors being different from each other in the angle between the optical axes of the light emitting and light-sensitive elements, said plurality of optical sensors comprising a first sensor having a large angle between the optical axes and a second sensor having a small angle between the optical axes; and control means responsive to said first sensor which senses said toner pattern image of said first pattern with a small amount of toner deposited thereon to prevent toner from being deposited on the background of the photoconductive element and responsive to said second sensor which senses said toner pattern image of said second pattern with a large amount of toner deposited thereon to control toner supply from said developing unit, said first sensor controlling a light voltage applied to an exposure lamp of an exposure unit of the image forming apparatus.

3. An image density control device for an image forming apparatus which develops an electrostatic latent image representative of an original document and formed on a photoconductive element by using a toner of a developing unit, senses an amount of toner deposited on said latent image, and controls image density on the basis of the sensed amount of toner deposition, said device comprising:

toner pattern image forming means for developing a plurality of reference density patterns each having a different density by using the toner and thereby forming toner pattern images on the photoconductive element, said plurality of reference density patterns comprising a first pattern having a low density and a second pattern having a high density;

a plurality of optical sensors each comprising a light emitting element for issuing light toward said toner pattern images and a light-sensitive element to which a regular reflection from said toner pattern images are incident, said plurality of optical sensors being different from each other in the angle between the optical axes of the light emitting and light-sensitive elements, said plurality of optical sensor comprising a first sensor having a large angle between the optical axes of a second sensor having a small angle between the optical axes; and control means responsive to said first sensor which senses said toner pattern image of said first pattern with a small amount of toner deposited thereon to prevent toner from being deposited on the background of the photoconductive element and responsive to said second sensor which senses said toner pattern image of said second pattern with a large amount of toner deposited thereon to control toner supply from said developing unit, said first sensor controlling a bias voltage applied to a developing roller of the developing unit.

4. An image density control device for an image forming apparatus which develops an electrostatic latent image representative of an original document and formed on a photoconductive element by using a toner of a developing unit, senses an amount of toner deposited on said latent image, and controls image density on the basis of the sensed amount of toner deposition, said device comprising:

toner pattern image forming means for developing a plurality of reference density patterns each having a different density by using the toner and thereby forming toner pattern images on the photoconductive element, said plurality of reference density patterns comprising a first pattern having a low density and a second pattern having a high density;

a plurality of optical sensors each comprising a light emitting element for issuing light toward said toner pattern images and a light-sensitive element to which a regular reflection from said toner pattern images are incident, said plurality of optical sensors being different from each other in the angle between the optical axes of the light emitting and light-sensitive elements, said plurality of optical sensors comprising a first sensor having a large angle between the optical axes and a second sensor having a small angle between the optical axes; and control means responsive to said first sensor which senses said toner pattern image of said first pattern with a small amount of toner deposited thereon to prevent toner from being deposited on the background of the photoconductive element and responsive to said second sensor which senses said toner pattern image of said second pattern with a large amount of toner deposited thereon to control toner supply from said developing unit, said first sensor controlling a light voltage applied to an exposure lamp of an exposure unit and a bias voltage applied to a developing roller of the developing unit.

5. An image density control device for an image forming apparatus which develops an electrostatic latent image representative of an original document and formed on a photoconductive element by using a toner of a developing unit, senses an amount of toner deposited on said latent image, and controls image density on the basis of the sensed amount of toner deposition, said device comprising:

toner pattern image forming means for developing a plurality of reference density patterns each having a different density by using the toner and thereby forming toner pattern images on the photoconductive element, said plurality of reference density patterns comprising a first pattern having a low density and a second pattern having a high density;

a plurality of optical sensors each comprising a light emitting element for issuing light toward said toner pattern images and a light-sensitive element to which a regular reflection from said toner pattern images are incident, said plurality of optical sensors being different from each other in the angle between the optical axes of the light emitting and light-sensitive elements, said plurality of optical sensors comprising a first sensor having a large angle between the optical axes and a second sensor having a small angle between the optical axes; and control means responsive to said first sensor which senses said toner pattern image of said first pattern with a small amount of toner deposited thereon to prevent toner from being deposited on the background of the photoconductive element and responsive to said second sensor which senses said toner pattern image of said second pattern with a large amount of toner deposited thereon to control toner supply from said developing unit, said second sensor controlling an amount of toner supplied from the developing unit, and said first sensor controlling a light voltage applied to an exposure lamp of an exposure unit and a bias voltage applied to a developing roller of the developing unit.

6. An image density control device for an image forming apparatus which develops an electrostatic latent image representative of an original document and formed on a photoconductive element by using a toner, senses an amount of toner deposited on said latent image, and controls image density on the basis of the sensed amount of toner deposition, said device comprising:

toner pattern image forming means for developing a plurality of reference density patterns each having a different density by using the toner and thereby forming toner pattern images on the photoconductive element; and optical sensor means comprising a light emitting element for issuing light toward said toner pattern images and a light-sensitive element to which a reflection from said toner pattern images is incident, said optical sensor means selecting an angle between optical axes of said light-emitting element and said light-sensitive element in association with the densities of said toner pattern images, said optical sensor means comprising a single optical sensor and angle changing means supporting the light emitting and light-sensitive elements of said single optical sensor for changing the angle between the optical axes of said light emitting and light-sensitive elements.

* * * * *